United States Patent [19]

Papsdorf

[11] 4,379,360

[45] Apr. 12, 1983

[54] METHOD OF MAKING A HINGE WITH AN INTEGRAL PINTLE

[75] Inventor: John Papsdorf, Lake Orion, Mich.

[73] Assignee: Liberty Hardware Manufacturing Corp., Long Island City, N.Y.

[21] Appl. No.: 166,536

[22] Filed: Jul. 7, 1980

[51] Int. Cl.[3] ..... E05D 11/10

[52] U.S. Cl. ..... 29/11; 16/321; 16/337; 16/386

[58] Field of Search ..... 16/128, 172, 168, 277, 16/375, 386, 321, 337; 29/11

[56] References Cited

U.S. PATENT DOCUMENTS

| | | | |
|---|---|---|---|
| 3,008,175 | 11/1961 | Biedinger et al. | 16/168 X |
| 3,557,402 | 1/1971 | Koehl | 16/168 |
| 4,287,641 | 9/1981 | MacDonald | 16/139 |

*Primary Examiner*—Werner H. Schroeder
*Assistant Examiner*—Andrew M. Falik
*Attorney, Agent, or Firm*—Henry Sternberg

[57] ABSTRACT

A method of making a hinge having a tongue component with an integral pin portion. The tongue component is formed by rolling up a free end of a shaped sheet metal blank and intermittently shaping the rolled portion with dies. The roll or degree of rotation inparted to the free end of the sheet metal blank to form the pin should preferably be between 475° and 550°.

4 Claims, 8 Drawing Figures

Figures 6, 7, 8:
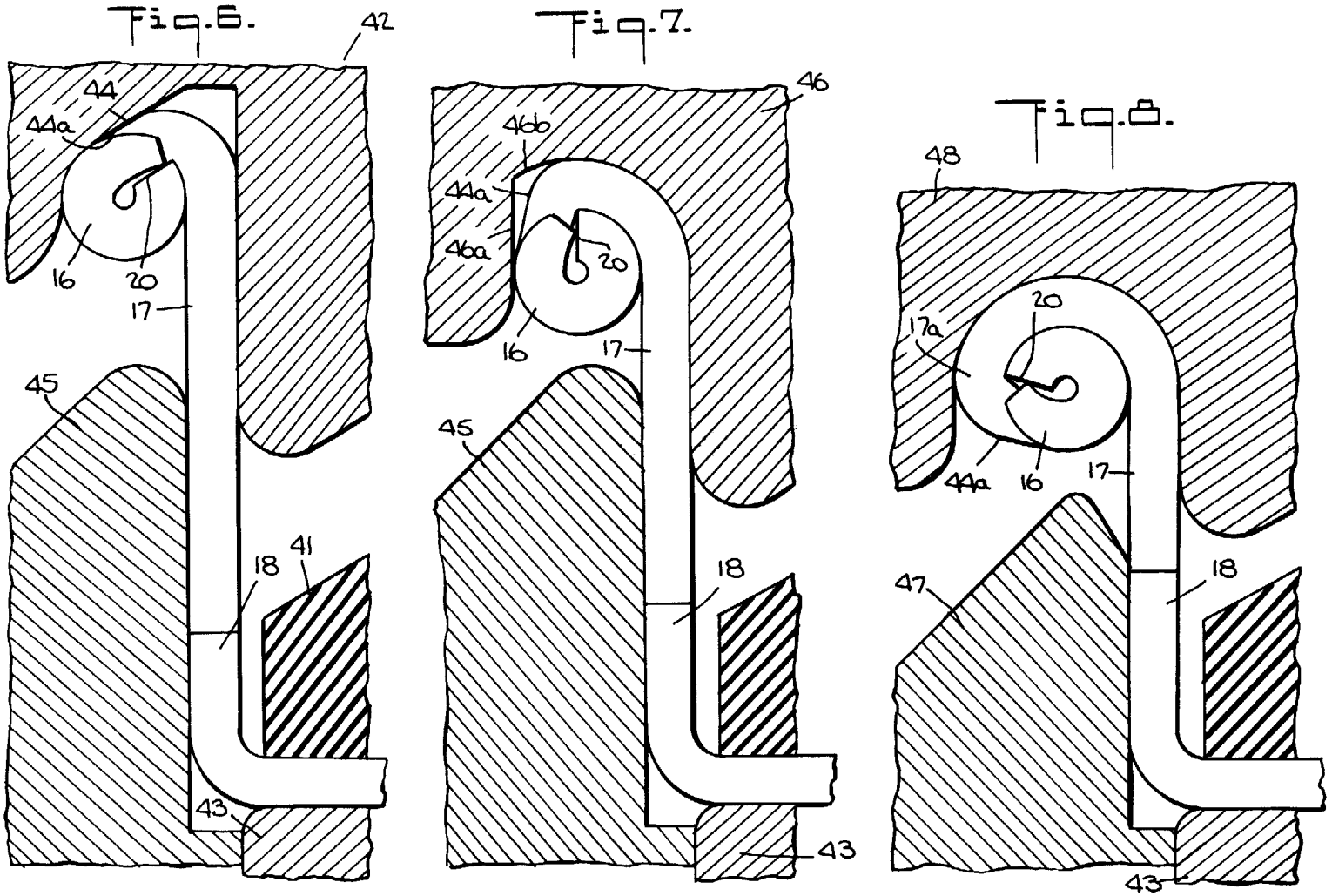

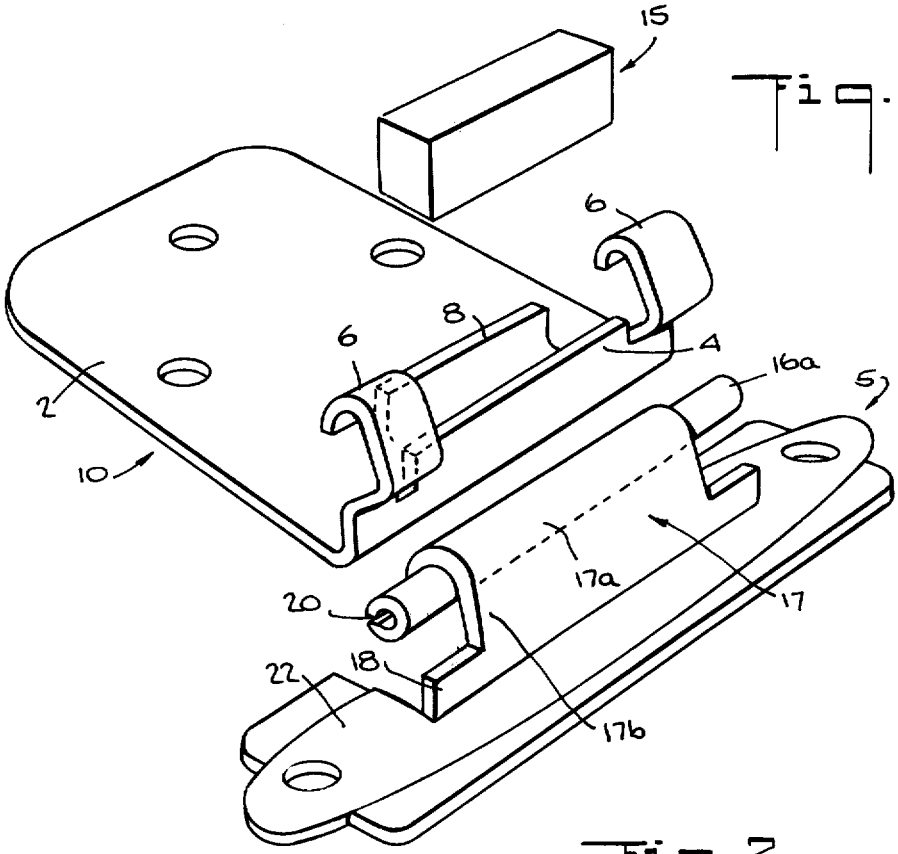
Fig. 1.
Fig. 2.
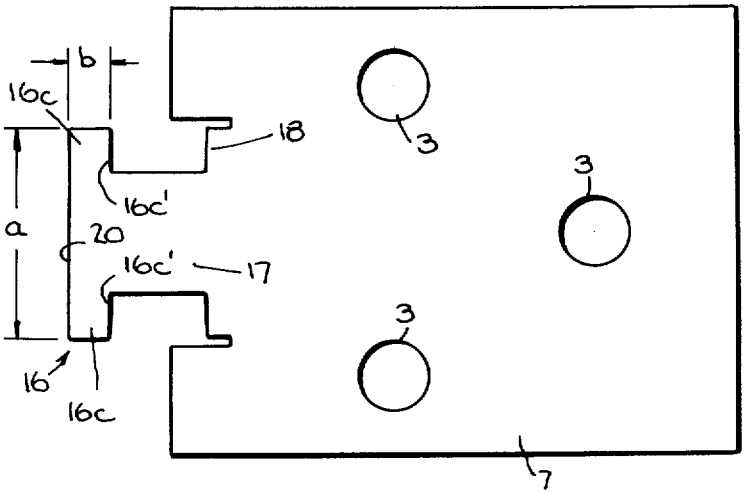

Fig. 4.
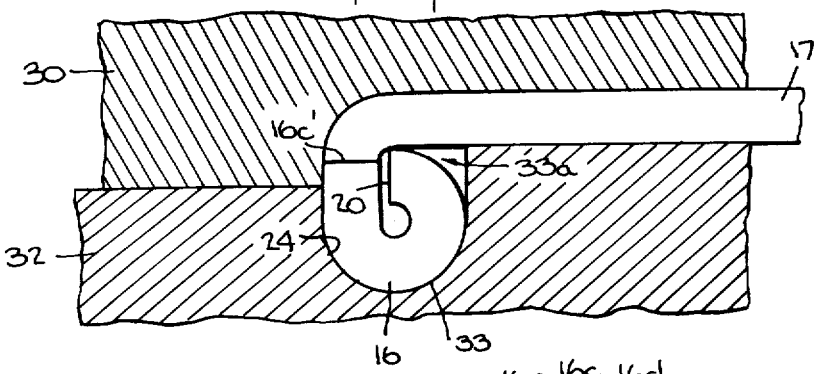
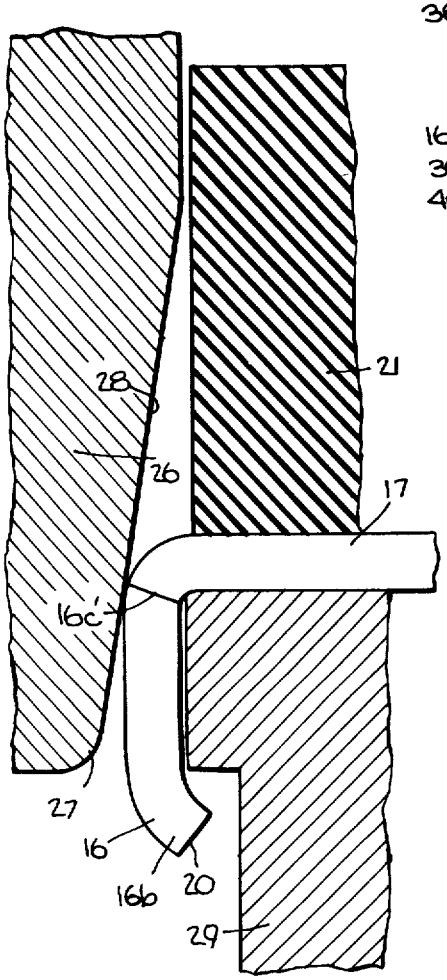
Fig. 3.
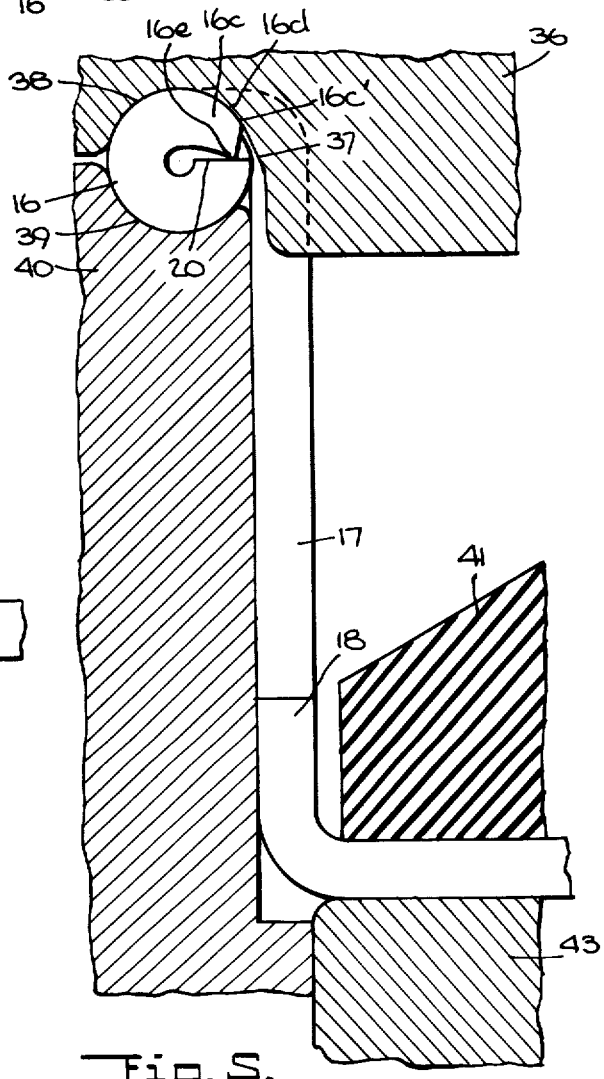
Fig. 5.

42
44
44a
20
16
17
45
41
18
43

46
46b
44a
46a
20
16
17
45
18
43

48
17a
20
16
44a
17
47
18
43

METHOD OF MAKING A HINGE WITH AN INTEGRAL PINTLE

This invention relates to an improved tongue hinge component having an integral pin and to a method of making same.

Tongue-and-knuckle hinged are well known and are employed in a variety of uses, such as for door hinges. Usually they comprise at least three major components: a first hinge member adapted to be mounted on a wall, a second hinge member adapted to be mounted on a door, and a hinge pin for pivotally connecting the first and second hinge members. See, for example, U.S. Pat. Nos. 3,205,532; 3,212,124; 3,255,484; 3,381,332; 3,381,333; and 3,568,241. It is also known to have spring hinges, or self-closing hinges, in which a fourth element, namely a spring means, cooperates with the pair of hinge members to urge them to pivot about the pin to positions toward and away from each other. See, for example, U.S. Pat. Nos. 3,381,332 and 3,381,333.

The present invention relates to a method of making a tongue hinge component having an integral pin and also to an improved tongue hinge component having an integral pin that functions as well in assembly as the separate pin component of the prior art, thereby eliminating the need for a separate pin member while at the same time providing a hinge that meets the standards of service and strength prevailing in the trade.

The ability to make a serviceable hinge in which the hinge pin is an integral part of the tongue component and both the pin and tongue component are made from a single sheet metal blank results in significantly reduced manufacturing costs and simplified assembly of the resultant hinges.

According to the invention, a tongue hinge component with integral pin is formed by rolling up a free end of a shaped sheet metal blank and intermittently shaping the rolled portion with dies. A hinge component so formed exhibits satisfactory strength for a typical sheet metal thickness thereof provided the roll or degree of rotation imparted to the free end of the sheet metal blank forming the pin exceeds 425°, and preferably is between 475° and 550°.

The invention is more clearly described in the drawings in which:

FIG. 1 is an exploded perspective view of a hinge assembly incorporating an improved male hinge component according to the present invention; and FIGS. 2 through 8 sequentially illustrate various of the intermediate steps and/or articles of manufacture involved in making an improved male hinge component according to the method of the invention. The dies shown in FIGS. 3 through 8 inclusive are all shown in vertical section, partly cut-away, operating on a hinge component shown in side elevation, partly cut-away.

FIG. 1 illustrates, in an exploded perspective view, the components of a self-closing hinge comprising as one component thereof one embodiment of an improved integral pin tongue hinge component according to the present invention. The hinge assembly includes tongue or male member 5, knuckle or female member 10 and spring means, in this case a resilient block, 15. Male member 5 comprises a mounting or base portion 22, a flange or shoulder portion 18 projecting from the base, an elongated sleeve-forming neck portion 17 angularly extending from shoulder 18, and a head portion consisting of an integral pin **16*a* axially projecting from the sleeve portion 17*a* of neck 17. As shown, pin 16*a* comprises a free end 20, the surface of which lies in a plane that has been rolled or rotated through a total angle of about 540° with respect to the plane of the uncurled portion 17*b* of neck 17. Female member 10 as illustrated comprises a mounting base 2, flange 4, two knuckle portions 6 and ledge 8 to coact with resilient block 15 and tongue member 5** to hold said components in pivotal assembly to form a self-closing hinge.

A preferred method of making a male hinge component with integral pin according to the present invention includes the step of forming a flat sheet metal blank shaped to include a base portion, a shoulder portion adjacent to and narrower than the base portion, a neck portion extending from and narrower than the shoulder portion, and a head portion extending from and wider than the neck portion and comprising a free end having a longitudinal outer edge.

Forming the male hinge member from the above-described blank includes the steps of: bending the head portion so that the plane of the surface of the outer longitudinal edge of the head portion is rotated approximately 45° with respect to its original perpendicular orientation with respect to the plane of the blank; bending the entire head portion approximately 90° with respect to the plane of the blank and in the same direction as the prior 45° bend by bending the neck portion at a location adjacent its intersection with the head portion; curling the head portion into the form of a rough cylinder by imparting approximately 225° additional rotation in the same rotational direction to said outer edge, preferably in a single operation; swaging the inner longitudinal edges of those parts of the head portion which extend longitudinally outward at opposite ends of the neck portion, and which will eventually form the portions of the pin that function as pivoting means, to impart a more cylindrical shape to the said pin-forming head portion; and curling and shaping the head and adjacent neck portion as a unit to achieve the desired final shape of the sleeve-forming part of the neck portion and the pin-forming head portions extending longitudinally therefrom. The bend(s) necessary to achieve the desired orientation of the shoulder portion with respect to the base and the neck portion with respect to the shoulder may be formed at any suitable point in the process of making the male hinge component, although the bending of the shoulder with respect to the base is preferably immediately following the above-mentioned 45° rotation step.

A preferred method according to this invention in the context of making an improved integral pin hinge component according to the invention and as illustrated in FIG. 1 will now be described in detail. As shown in FIG. 2, a flat sheet metal blank 1 of any suitable material is fashioned to have a first portion 7 having a generally rectangular shape adapted to support the blank during the manufacturing process and to be formed into the mounting base of the hinge component and including holes 3 used for pilots a second or head portion 16 remote from said first portion, said head portion including outer longitudinal edge 20 and two projecting ends **16*c* having inner longitudinal edges 16*c*' and adapted to be formed into the integral pin 16*a* of the improved hinge component; a third portion or neck means 17 intermediate said first and second portions, extending from and narrower than the second portion and adapted to be formed into the tongue or sleeve-forming portion of the hinge; and a fourth portion or shoulder 18 intermediate said first and third portions, extending outwardly from and narrower than the first portion and adapted to be formed into the hinge shoulder or flange. As will be seen, the improved integral pin 16a is formed from head portion 16 by curling and shaping the portion into a substantially solid cylinder. Thus the length dimension a of head portion 16, in what will ultimately be the axial direction of the resultant pin, will determine the length of the pin and the width dimension b of the rectangularly shaped head 16 will, together with the thickness of the blank and the degree of curling, determine the diameter of pin 16a**. Although all of these dimensions may be varied it is preferred, for typical applications, to utilize a pin diameter of from two to three times the thickness of the blank. This consideration dictates a width dimension b of from four to five times the blank thickness.

With continued reference to FIG. 2, the forward portion 16b of head portion 16 is first bent along its length at an angle of about 45°, thereby rotating the plane in which the surface of edge 20 lies, by an angle of approximately 45° out of its initial perpendicular orientation to the plane of the remainder of the sheet metal blank. (See FIG. 3.)

Neck portion 17 is then bent at a 90° angle, as illustrated in FIG. 3, along a line parallel to and slightly to the right (as viewed in FIG. 2) of the imaginary line separating neck portion 17 and head portion 16 and in the same rotational direction (i.e., counterclockwise as viewed in FIG. 3) as the 45° bend in head portion 16. The 90° bend is imparted by the cooperation of upper die 26 operating on head portion 16, lower die 29 supporting neck 17 from below, and spring pad 21 on top of neck 17. The rounded leading edge 27 of upper die 26 begins the bending motion and the inclined plane surface 28 of upper die 26 effectively forces head 16 into the full 90° angle bend with respect to the remainder of neck 17 and the rest of the metal blank.

The plane containing the surface of outer longitudinal edge 20 of head portion 16 (hereinafter referred to as the outer edge plane), which has already been rotated through a total angle of about 135° (as shown in FIG. 3), is then rotated or curled through an additional angle of approximately 225° in a single operation as shown in FIG. 4, and head portion 16 then assumes the form of a substantially solid cylinder having one partially flat side 24. As shown, upper die 30 conforms, in vertical section, to the shape of the top surface of the neck portion 17 and head portion 16 resulting from the step illustrated in FIG. 3, while lower die 32 has a longitudinal groove 33a having a surface 33 which is generally semicircular in cross-section. Die 30 cooperates with die 32 to force the outer longitudinal edge 20, specifically the outer edge plane, through a rotation of approximately 225° in the aforesaid counterclockwise direction of rotation. When performed in the indicated manner, this step of the process produces a substantial amount of heat which, in the production of hinges at commercial rates, would result in the dies, particularly the die 32 along surface 33, having "hot spots" of excessive heat resulting in rapid deterioration of the dies. Preferably, therefore, the longitudinal length of groove 33a should be such that the metal pieces being formed at this stage can be cycled in longitudinal direction along the length of such groove to prevent excessive localized heating. Thus dies 32 should preferably have a dimension in the axial direction of the now quasi-cylindrically shaped head portion 16 that is substantially greater than the dimension a of head portion 16, in order to permit this forming operation on successive articles to be carried out in cooperation with different longitudinally positioned regions of the groove surface 33. Cooling means are preferably employed to even further reduce the localized heating. The movement of successive workpieces 1 preparatory to each operation of the die press can be accomplished by known means for moving workpieces of this type between successive operations of a die press.

Shoulder or second portion 18 is next bent (step not shown), along its boundary with the first portion 7, to form a right angle with respect to the remainder of the blank, i.e., to the configuration shown in the lower half of FIG. 5. The formation of the integral pin and tongue member follows by completing the rotation of the outer edge plane, in this case by curling it counterclockwise through an additional angle of approximately 180°, while simultaneously forming sleeve 17a and imparting final shapes to the pin 16a and to the portion of the neck 17 which is most remote from first portion 7 of blank 2. The sequential steps and die shapes used in these final rolling and shaping operations are respectively illustrated in FIGS. 5, 6, 7 and 8.

The step of FIG. 5 employs the cooperation of upper die 36, lower die 40, spring pad 41 and support 43 to form projecting ends 16c into the shape of a pair of substantially solid cylinders, without effecting any significant change in the shape of neck 17 or that part 16d of head 16 which is immediately adjacent neck 17 and not longitudinally projecting therefrom. To accomplish this, upper die 36 has a pair of inclined surfaces 37 developing into grooves having a generally semi-circular cross section defined by surfaces 38 operating respectively on each of the two axially projecting head portions 16c in conjunction with the generally semi-cylindrically shaped surface 39 of lower die 40, which extends about 135° around the bottom periphery of each of said portions 16c. The inclined surfaces of die 36 force the upper inner longitudinal edges 16c' of the portions 16c toward the surface of outer longitudinal edge 20, having a deforming, or swaging, effect on edges 16c' and also acting to shear the portions 16c partially away from the adjacent head portion 16d in the region of the boundary between head 16 and neck 17. By this operation the lower inner longitudinal edge 16e is preferably brought into contact with the surface of edge 20. It will be noted that in the step shown in FIG. 5, the upper die 36 operates only on the portion 16c and does not operated on the central, i.e. non-projecting portion of head 16.

In the step shown in FIG. 6, upper die 42 operates on the central, non-projecting portion of head 16 and the adjacent portion of neck 17 and does not contact the projecting ends 16c thereof. Die 42 cooperates with a support consisting of lower member 45 for providing vertical support and spring pad 41 and support 43 for supporting the portion 7, to curl neck 17, and consequently the head 16, approximately 45° in the same counterclockwise direction so that thereafter the outer edge plane will have been rotated a total of approximately 405° with respect to the plane of the uncurled portion of neck 17. In this step the contact is between an inclined flat surface 44 of the die 42 and neck 17 and the aforementioned non-projecting central portions of head 16. The flat surface 44a formed by die 42 will ultimately form the cam-like surface cooperating with a spring or resilient means 15 in a self-closing door hinge. The initial curling by die 42 is accomplished by the leading convex curved surface 44' of die 42.

Upper die 46, in the step illustrated in FIG. 7, operates on the central portion of head 16 and neck 17 and need not contact the axially projecting portions 16c forming the free ends of the pin 16a. The die 46 has a flat vertical portion 46a and a curved portion 46b which, in cooperation with a support system consisting of member 45, spring pad 41 and support 43, further twist head 16 and neck 17, and consequently also pin 16a, an additional approximately 45° while simultaneously further curling that part of neck portion 17 adjacent flat surface 44a around the pin 16a so as to partially form sleeve 17a.

In the step illustrated in FIG. 8, the semi-circular cross-section of upper die 48, in cooperation with a support system consisting of lower support 47, spring pad 41 and support 43, operates on neck 17 to complete the formation of sleeve 17a, around the central portion of pin 16a by curling the neck 17 and with it the pin 16a approximately 90° further, resulting in what is now the fully formed integral pin 16a, a cam surface 44a for coacting with resilient means 15 in the self-closing door hinge of FIG. 1, and a substantially semi-cylindrical portion comprising the end of neck 17 remote from the shoulder 18 and forming sleeve 17a extending about 270° around the periphery of pin 16a. The pin 16a which is formed in accordance with this invention extends longitudinally through and is surrounded and thus peripherally supported by sleeve 17a along approximately three-quarters of its periphery.

Fabrication of the hinge member 5 is preferably completed by the following steps, which are not illustrated since they are well known to those skilled in the art of manufacturing self closing hinges: bending neck 17 at the intersection of neck 17 and the flange or shoulder 18 to the desired angle, preferably about 30° from the vertical; forming the desired mounting base for the hinge component; and stamping the finished component from the remainder of the blank to yield the finished hinge component 5 of FIG. 1.

It has been found that a hinge component having an integral pin 16a formed by rotating the outer edge plane more than 425° from its original orientation with respect to the plane of the uncurled portion of neck 17, preferably in the range of about 475° to about 550°, exhibits adequate strength and related properties to meet the strength and related standards of the marketplace for hinge applications commensurate with the standard use of metals and the thicknesses thereof commonly used in the art of making hinges of the general type shown.

A self-closing hinge incorporating the three components of FIG. 1 is assembled by inserting the projecting ends of pin 16a of the male component into the respective semi-cylindrical openings of knuckles 6 of the female component and then inserting resilient block 15 into the space bounded by base 2 on the bottom, ledge 8 and flange 4 on the sides and the outer surface of sleeve 17a and cam-like surface 44a on the top. Properly sized and configured to ensure a compression fit between cam surface 44a of member 5 and the base 2 of member 10, resilient block 15 serves both as spring means to coact with the cam-like surface 44a in providing a self-closing door hinge and to hold members 5 and 10 in assembly.

Although the embodiment of the invention according to the detailed description has a cam surface intended to cooperate with resilient or spring means in a self-closing hinge for a latchless door, the improved integral pin hinge component and method of the invention may be utilized in more conventional hinge applications not requiring such a cam surface or resilient means. Also, although the exemplary improved hinge component is shown with a male member having pin means axially projecting from both sides thereof, improved hinge components according to the invention may also be constructed in such a way that the male member has pin means projecting from only one side of the neck forming sleeve.

I claim:

1. A method of forming a male hinge member having a mounting base, substantially cylindrical pin means remote from said base, and neck means intermediate said base and said pin means, the end of said neck means most remote from said base being curled and forming a partial sleeve around said pin means, said method including the steps of:

(a) forming a flat sheet metal blank having a first portion adapted to be formed into said mounting base, a second portion remote from said first portion and adapted to be formed into said pin means, said second portion comprising an outer longitudinal edge and two inner longitudinal edges, said inner edges and the associated portions of said outer edge defining two projecting ends of said second portion, said outer edge having a surface lying in a plane perpendicular to the plane of said blank, and a third portion, intermediate and narrower than said first and second portions, connected to said second portion and adapted to be formed into said neck means;

(b) bending the outermost portion of said second portion so that the plane in which the surface of said outer longitudinal edge lies is rotated substantially 45° in a given direction of rotation with regard to the plane of the remainder of said second portion;

(c) bending the end of said third portion remote from said base substantially 90° in said given direction of rotation, thereby turning said second portion in its entirety approximately 90° further in said direction;

(d) curling said second portion with respect to itself so that said outer edge plane is rotated an additional angle of approximately 225° in said given direction of rotation, whereby said outer edge plane is brought into proximity to the region of the third portion at which the latter is connected to the second portion and said outer edge plane is substantially perpendicular to the plane of said third portion and whereby said second portion is formed into semi-cylindrical shape;

(e) shearing the upper inner longitudinal edge portions, of said semi-cylindrically-shaped second portion, from said third portion in the region of the respective boundaries of said upper inner edges and said third portion;

(f) swaging the inner longitudinal edge portions of said semi-cylindrically-shaped second portion so as to curl said inner longitudinal edge portions in such a direction as to form said projecting ends into substantially cylindrical shapes, thereby to form a longitudinally-extending pin having two substantially cylindrical end portions;

(g) curling said second and third portions, as a unit, further in said given direction of rotation approximately 45°, so as to form the end of said third portion most remote from said base into a sleeve extending partially about said pin;

(h) curling said sleeve and pin portions, as a unit, further in said given direction of rotation, an additional approximately 45° so that said sleeve portion extends approximately 180° around the periphery of said pin portion; and (i) rolling said sleeve and pin portions, as a unit, in said given direction of rotation approximately an additional 90°, such that said outer edge plane has been rotated through an angle of approximately 540° from its starting position with respect to the plane of the uncurled end of said third portion and said sleeve portion extends around about three-quarters of the periphery of said pin portion;

wherein step (d) comprises placing said outer edge in and along one longitudinal edge of a die groove having a substantially semi-circular cross-section and forcing said outer edge of said second portion further into said groove whereby said outer edge is forced to slide circumferentially around the inner surface of said groove so as to be curled into a substantially semi-cylindrical shape and wherein the longitudinal length of said groove is substantially greater than the longitudinal length of said outer edge and the outer edges of successive metal blanks are positioned along different longitudinal regions of said groove for said curling step, comprising the step of moving successive blanks to be formed to different longitudinal regions of said groove.

2. A method of forming a male hinge member having a mounting base, substantially cylindrical pin means remote from said base, and neck means intermediate said base and said pin means, the end of said neck means most remote from said base being curled and forming a partial sleeve around said pin means, said method including the steps of:

(a) forming a flat sheet metal blank having a first portion adapted to be formed into said mounting base, a second portion remote from said first portion and adapted to be formed into said pin means, said second portion comprising an outer longitudinal edge and two inner longitudinal edges, said inner edges and the associated portions of said outer edge defining two projecting ends of said second portion, said outer edge having a surface lying in a plane perpendicular to the plane of said blank, and a third portion, intermediate and narrower than said first and second portions, connected to said second portion and adapted to be formed into said neck means;

(b) bending the outermost portion of said second portion so that the plane in which the surface of said outer longitudinal edge lies is rotated substantially 45° in a given direction of rotation with regard to the plane of the remainder of said second portion;

(c) bending the end of said third portion remote from said base substantially 90° in said given direction of rotation, thereby turning said second portion in its entirety approximately 90° further in said direction;

(d) curling said second portion with respect to itself so that said outer edge plane is rotated an additional angle of approximately 225° in said given direction of rotation, whereby said outer edge plane is brought into proximity to the region of the third portion at which the latter is connected to the second portion and said outer edge plane is substantially perpendicular to the plane of said third portion and whereby said second portion is formed into semi-cylindrical shape;

(e) shearing the upper inner longitudinal edge portions, of said semi-cylindrically-shaped second portion, from said third portion in the region of the respective boundaries of said upper inner edges and said third portion;

(f) swaging the inner longitudinal edge portions of said semi-cylindrically-shaped second portion so as to curl said inner longitudinal edge portions in such a direction as to form said projecting ends into substantially cylindrical shapes, thereby to form a longitudinally-extending pin having two substantially cylindrical end portions;

(g) curling said second and third portions, as a unit, further in said given direction of rotation approximately 45°, so as to form the end of said third portion most remote from said base into a sleeve extending partially about said pin;

(h) curling said sleeve and pin portions, as a unit, further in said given direction of rotation, an additional approximately 45° so that said sleeve portion extends approximately 180° around the periphery of said pin portion; and (i) rolling said sleeve and pin portions, as a unit, in said given direction of rotation approximately an additional 90°, such that said outer edge plane has been rotated through an angle of approximately 540° from its starting position with respect to the plane of the uncurled end of said third portion and said sleeve portion extends around about three-quarters of the periphery of said pin portion;

wherein the shearing and swaging of steps (e) and (f) are carried out in a single step employing a die having two substantially identical grooves, each of said grooves operating on one of said inner longitudinal edges and its associated projecting end and shaped to have a generally semi-cylindrical cross-section comprising an inclined plane straight section developing into said generally semi-cylindrical cross-section.

3. A method of forming a male hinge member having a mounting base, substantially cylindrical pin means remote from said base, and neck means intermediate said base and said pin means, the end of said neck means most remote from said base being curled and forming a partial sleeve around said pin means, said method including the steps of:

(a) forming a flat sheet metal blank having a first portion adapted to be formed into said mounting base, a second portion remote from said first portion and adapted to be formed into said pin means, said second portion comprising an outer longitudinal edge and two inner longitudinal edges, said inner edges and the associated portions of said outer edge defining two projecting ends of said second portion, said outer edge having a surface lying in a plane perpendicular to the plane of said blank, and a third portion, intermediate and narrower than said first and second portions, connected to said second portion and adapted to be formed into said neck means;

(b) bending the outermost portion of said second portion so that the plane in which the surface of said outer longitudinal edge lies is rotated substantially 45° in a given direction of rotation with regard to the plane of the remainder of said second portion;

(c) bending the end of said third portion remote from said base substantially 90° in said given direction of rotation, thereby turning said second portion in its entirety approximately 90° further in said direction;

(d) curling said second portion with respect to itself so that said outer edge plane is rotated an additional angle of approximately 225° in said given direction of rotation, whereby said outer edge plane is brought into proximity to the region of the third portion at which the latter is connected to the second portion and said outer edge plane is substantially perpendicular to the plane of said third portion and whereby said second portion is formed into semi-cylindrical shape;

(e) shearing the upper inner longitudinal edge portions, of said semi-cylindrically-shaped second portion, from said third portion in the region of the respective boundaries of said upper inner edges and said third portion;

(f) swaging the inner longitudinal edge portions of said semi-cylindrically-shaped second portion so as to curl said inner longitudinal edge portions in such a direction as to form said projecting ends into substantially cylindrical shapes, thereby to form a longitudinally-extending pin having two substantially cylindrical end portions;

(g) curling said second and third portions, as a unit, further in said given direction of rotation approximately 45°, so as to form the end of said third portion most remote from said base into a sleeve extending partially about said pin;

(h) curling said sleeve and pin portions, as a unit, further in said given direction of rotation, an additional approximately 45° so that said sleeve portion extends approximately 180° around the periphery of said pin portion; and (i) rolling said sleeve and pin portions, as a unit, in said given direction of rotation approximately an additional 90°, such that said outer edge plane has been rotated through an angle of approximately 540° from its starting position with respect to the plane of the uncurled end of said third portion and said sleeve portion extends around about three-quarters of the periphery of said pin portion;

wherein the curling of step (g) employs a die having a groove comprising a cross-sectional shape including an inclined plane section operating on the area of the boundary between said second and third portions and intermediate said two projecting ends.

4. A method of forming a male hinge member having a mounting base, substantially cylindrical pin means remote from said base, and neck means intermediate said base and said pin means, the end of said neck means most remote from said base being curled and forming a partial sleeve around said pin means, said method including the steps of:

(a) forming a flat sheet metal blank having a first portion adapted to be formed into said mounting base, a second portion remote from said first portion and adapted to be formed into said pin means, said second portion comprising an outer longitudinal edge and two inner longitudinal edges, said inner edges and the associated portions of said outer edge defining two projecting ends of said second portion, said outer edge having a surface lying in a plane perpendicular to the plane of said blank, and a third portion, intermediate and narrower than said first and second portions, connected to said second portion and adapted to be formed into said neck means;

(b) bending the outermost portion of said second portion so that the plane in which the surface of said outer longitudinal edge lies is rotated substantially 45° in a given direction of rotation with regard to the plane of the remainder of said second portion;

(c) bending the end of said third portion remote from said base substantially 90° in said given direction of rotation, thereby turning said second portion in its entirety approximately 90° further in said direction;

(d) curling said second portion with respect to itself so that said outer edge plane is rotated an additional angle of approximately 225° in said given direction of rotation, whereby said outer edge plane is brought into proximity to the region of the third portion at which the latter is connected to the second portion and said outer edge plane is substantially perpendicular to the plane of said third portion and whereby said second portion is formed into semi-cylindrical shape;

(e) shearing the upper inner longitudinal edge portions, of said semi-cylindrically-shaped second portion, from said third portion in the region of the respective boundaries of said upper inner edges and said third portion;

(f) swaging the inner longitudinal edge portions of said semi-cylindrically-shaped second portion so as to curl said inner longitudinal edge portions in such a direction as to form said projecting ends into substantially cylindrical shapes, thereby to form a longitudinally-extending pin having two substantially cylindrical end portions;

(g) curling said second and third portions, as a unit, further in said given direction of rotation approximately 45°, so as to form the end of said third portion most remote from said base into a sleeve extending partially about said pin;

(h) curling said sleeve and pin portions, as a unit, further in said given direction of rotation, an additional approximately 45° so that said sleeve portion extends approximately 180° about the periphery of said pin portion; and (i) rolling said sleeve and pin portions, as a unit, in said given direction of rotation approximately an additional 90°, such that said outer edge plane has been rotated through an angle of approximately 540° from its starting position with respect to the plane of the uncurled end of said third portion and said sleeve portion extends around about three-quarters of the periphery of said pin portion;

wherein the curling of step (h) employs a die having a groove comprising a cross-sectional shape having a flat side wall portion and the remainder thereof being arcuate and comprises initially engaging the sleeve with said flat side wall portion of the groove thereby bending the sleeve and consequently the pin a given amount and thereafter forcing the sleeve further into said groove so as to assume the arcuate shape of the arcuate position of the groove.

* * * * *